United States Patent [19]

Spiegel

[11] Patent Number: 4,757,762

[45] Date of Patent: Jul. 19, 1988

[54] TENSIONING DEVICE ON A PLATE CYLINDER OF A ROTARY PRINTING MACHINE

[75] Inventor: Nikolaus Spiegel, Walldorf, Fed. Rep. of Germany

[73] Assignee: Heidelberger Druckmaschinen AG, Heidelberg, Fed. Rep. of Germany

[21] Appl. No.: 870,228

[22] Filed: Jun. 3, 1986

[30] Foreign Application Priority Data

Jun. 3, 1985 [DE] Fed. Rep. of Germany ..... 3519869

[51] Int. Cl.[4] ..... B41F 1/28

[52] U.S. Cl. ..... 101/415.1

[58] Field of Search ..... 101/415.1, 375, 378, 101/247, 407 R, 408

[56] References Cited

U.S. PATENT DOCUMENTS 2,072,909 3/1937 Stephenson ..... 101/378

3,151,553 10/1964 Norton ..... 101/415.1

3,828,672 8/1974 Gazzola et al. ..... 101/247

FOREIGN PATENT DOCUMENTS 817441 7/1959 United Kingdom ..... 101/415.1

*Primary Examiner*—Edgar S. Burr

*Assistant Examiner*—Moshe I. Cohen

*Attorney, Agent, or Firm*—Herbert L. Lerner; Laurence A. Greenberg

[57] ABSTRACT

A tensioning device including a tensioning rail on a plate cylinder of a rotary printing machine for tensioning a trailing end of a printing plate, with a clamping device for the end of the clamped printing plate against a force of compression springs, the tensioning rail being disposed in a channel formed in the plate cylinder, comprising means defining at least one opening at the tensioning rail, the opening being in alignment with a recess formed in the bottom of the cylinder channel so that a lever-type tool is insertable in both the openings and the recess.

5 Claims, 1 Drawing Sheet

TENSIONING DEVICE ON A PLATE CYLINDER OF A ROTARY PRINTING MACHINE

Figure 1:
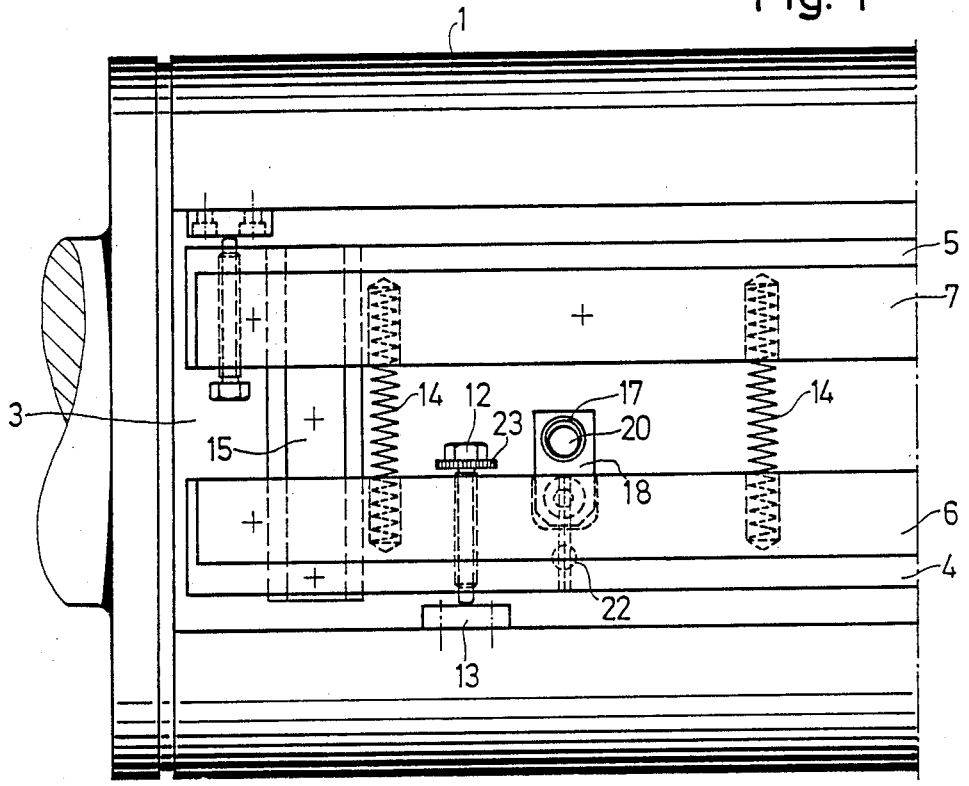

The invention relates to a tensioning device including a tensioning rail on a plate cylinder of a rotary printing machine and, more particularly, for tensioning a trailing end of a printing plate, with a clamping device for the end of the plate, and tensioning screws for tensioning an applied and clamped printing plate against a force of compression springs, the tensioning rail being disposed in a channel formed in the plate cylinder.

Such tensioning devices serve the purpose of mounting and tensioning or clamping flexible printing plates on the plate cylinder of rotary printing machines. Especially the trailing plate tensioning rail, as viewed in rotary direction of the plate cylinder, must transmit the tension forces to the end of the plate via a great number of tensioning screws. Owing to the flexibility of the printing plate, several full turns of the tensioning screws are required until the appropriate tensile force has been attained. That means that alternately each of the individual tensioning screws has to be tightened to some degree in order to avoid distortion of the printing plate clamped by the tensioning rail. Therefore, the tool for tightening the tensiong screws often has to be shifted during the tensioning.

To align the tensioning rail prior to mounting another plate, the rail must be moved back to its initial position via the tensioning screws so that, also for this purpose, the tool often has to be shifted. In so doing, the tensioning screws cannot be turned manually because the force of the compression springs existing between the two tensioning rails has to be so great that the rails do not move when the machine is running without a printing plate having been mounted.

During the removal or disassembly of the plate, the printing plate often sticks in the opened slot of the tensioning rail due to ink and gumming residues. In this case, the printing plate can only be loosened without damage by further tightening the tensioning screws which is time-consuming, the time consumption being aggravated by the fact that the screws have to be turned or screwed back again to their initial positions. In view of the fact that, in modern printing machines having several printing units, a corresponding number of printing plates has to be changed, considerably long changeover periods must currently be taken into account, which deteriorate the overall efficiency of the printing machine.

It is accordingly an object of the invention to provide a tensioning device of the foregoing type wherein the spring and adhering force of the printing plate is overcome, thus accelerating the tensioning itself.

With the foregoing and other objects in view, there is provided, in accordance with the invention a tensioning device including a tensioning rail on a plate cylinder of a rotary printing machine for tensioning a trailing end of a printing plate, with a clamping device for the end of the plate, and tensioning screws for tensioning an applied and clamped printing plate against a force of compression springs, the tensioning rail being disposed in a channel formed in the plate cylinder, comprising means defining at least one opening at the tensioning rail, the opening being in alignment with a recess formed in the bottom of the cylinder channel so that a lever-type tool is insertable in both the opening and the recess.

By using a lever-type tool and its lever action an independent additional force can be exerted on the trailing tensioning rail for a short time, thereby overcoming the spring force so that the tensioning screws can be turned or screwed back very fast by hand when inserting or applying another printing plate. If a printing plate is to be removed from the plate cylinder after completion of the printing job, and the trailing end of the printing plate sticks in the tensioning rail, the tensioning rail can be moved briefly in the tensioning direction by means of the lever-type tool, thereby loosening the adhesion. Due to these independent additional forces being applied by means of a lever-type tool which usually forms part of the printing machine and is required for other purposes, a printing plate can be removed from the plate cylinder within a very short time and the tensioning rail can be moved back to its initial position. Then, only the tensioning screws have yet to be actuated by means of an appropriate tool, when mounting and tensioning another printing plate.

In accordance with another feature of the invention, the means defining the opening is a flat body fastened to the tensioning rail.

In accordance with a further feature of the invention, play is provided between the opening and the lever-type tool for permitting lateral and circumferential movements of the lever-type tool.

In accordance with an additional feature of the invention, the tensioning rail is laterally movable into a stop location by means of the lever-type tool.

In accordance with a concomitant feature, the tensioning screws are formed with knurled discs, the knurled discs and flat body being optically marked by color.

The foregoing additional features of the invention also permit rapid alignment of the tensioning rail in the lateral direction, it being immaterial whether a divided trailing tensioning rail is used or not.

Other features which are considered as characteristic for the invention are set forth in the appended claims.

Although the invention is illustrated and described herein as embodied in tensioning device on a plate cylinder of a rotary printing machine, it is nevertheless not intended to be limited to the details shown, since various modifications and structural changes may be made therein without departing from the spirit of the invention and within the scope and range of equivalents of the claims.

Figure 2:
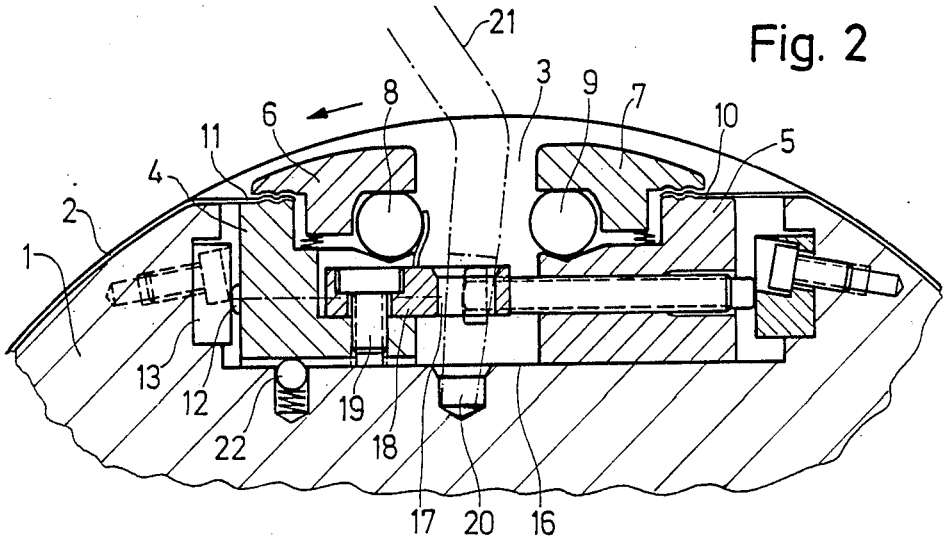

The construction and method of operation of the invention, however, together with additional objects and advantages thereof will be best understood from the following description of specific embodiments when read in connection with the accompanying drawing, in which:

FIG. 1 is a fragmentary top plan view of tensioning rails according to the invention on a plate cylinder, and FIG. 2 is an enlarged fragmentary cross-sectional view of the plate cylinder showing the tensioning device according to the invention.

Referring now to the figures of the drawing, it is noted that in rotary offset printing machines, a thin printing plate 2 is mounted and clamped on a plate cylinder 1. In a cylinder channel 3, tensioning means are provided for exact and in-register mounting and tensioning or clamping of the plate 2 on the plate cylinder 1. To this purpose, tensioning rails 4 and 5 are used to which clamping rails 6 and 7 are assigned, which, in turn, are actuated by clamping eccentrics 8 and 9. A leading end of the plate 10 is clamped between the tensioning rail 5 and the clamping rail 7 after having been aligned in register, and the printing plate 2 is applied to the peripheral surface of the plate cylinder 1 by turning the latter.

The trailing end of the plate 11 is also clamped between the tensioning rail 4 and the clamping rail 6 by turning the clamping eccentric 8 and, thereafter, the printing plate 2 is tensioned by tensioning or clamping screws 12, which brace themselves against a stop 13. Compression springs 14 are provided between the tensioning rails 4 and 5 and serve to prevent an undesired movement of the tensioning rails when no printing plate has as yet been inserted or applied. Both tensioning rails 4 and 5 are guided in rails 15 which are fastened to the bottom 16 of the cylinder channel 3.

On the tensioning rail 4 for the trailing end of the plate 11, a flat body 18 formed with openings 17 is provided, the flat body 18, in turn, being fastened to the tensioning rail 4 by a screw 19. In alignment with the openings 17, recesses 20 are provided in the bottom 16 of the cylinder channel 3, the recesses 20 being formed as bores in the illustrated embodiment. A lever-type tool 21, which can be a pin wrench, can be inserted through the opening 17 into the recess 20 so that an independent additional force can be exerted on the trailing tensioning rail 4 for a short time via the lever action of the pin wrench. This force can then move the tensioning rail in the direction of tensioning, thereby loosening a possibly adhering plate end. However, this force can also overcome the spring force of the compression spring 14 so that the tensioning screws can easily be screwed back manually in order to cause the tensioning rails supported by the compression spring 14, to slide into their initial positions by pivoting the lever-type tool, so that, thereafter, another printing plate can be clamped.

Advantageously, play is provided between the opening 17 and the lever-type tool 21 to permit lateral and circumferential movements of the lever 21, so that also alignment of the tensioning rail 4 laterally can be performed. In order to move the tensioning rail 4 also laterally into its initial position when inserting another printing plate, the tensioning rail 4 can be provided with a register or stop location which e.g. can be constructed as a conventional ball catch or notch 22. For easier handling, the tensioning screws 12 may be provided with a colored knurled disk 23. The flat bodies 18 and the tensioning screws 12 can be optically emphasized by being marked by color, thus facilitating the machine operator's work.

Futhermore, the length of the lever tool 21 is also constructed so as to permit easy handling thereof. Owing to the construction of the embodiment according to the invention, it is thus necessary only to shift the tool for the tensioning screws 12 when mounting and tensioning or clamping another printing plate, the time required for removing the printing plate and for inserting a new one being thereby considerably reduced.

The foregoing is a description corresponding, in substance, to German application No. P 35 19 869.9, dated June 3, 1985, International priority of which is being claimed for the instant application, and which is hereby made part of this application. Any material discrepancies between the foregoing specification and the specification of the aforementioned corresponding German application are to be resolved in favor of the latter.

There is claimed:

1. A tensioning device including a tensioning rail on a plate cylinder of a rotary printing machine for tensioning a trailing end of a printing plate, with a clamping device for the end of the plate, and tensioning screws for tensioning an applied and clamped printing plate against a force of compression springs, a channel formed in the plate cylinder, said channel having a recess formed in the bottom thereof, the tensioning rail being disposed in said channel formed in the plate cylinder, means defining at least one opening at the tensioning rail, said opening being in alignment with said recess formed in the bottom of the cylinder channel, and a lever-type tool insertable through said opening and into said recess, said means defining said opening including a surface engageable by said lever-type tool at a location intermediate the ends of said tool, and said recess having a defining surface serving as a fulcrum for and at one end of said lever-type tool, whereby the tensioning rail may be dislodged in tensioning direction against the force of the compression springs.

2. A tensioning device according to claim 1, wherein said means defining said opening is a flat body fastened to the tensioning rail.

3. A tensioning device according to claim 1 wherein play is provided between said opening and said lever-type tool for permitting lateral and circumferential movements of said lever-type tool.

4. A tensioning device according to claim 1, wherein the tensioning rail is laterally movable into a stop location by means of said lever-type tool.

5. A tensioning device according to claim 2, wherein the tensioning screws are formed with knurled discs, said knurled discs and said flat body being optically marked by color.

* * * * *